US005462445A

United States Patent [19]

Anhalt

[11] Patent Number: 5,462,445

[45] Date of Patent: Oct. 31, 1995

[54] SWITCHING CONNECTOR

[75] Inventor: John W. Anhalt, Orange, Calif.

[73] Assignee: ITT Corporation, New York, N.Y.

[21] Appl. No.: 265,882

[22] Filed: Jun. 27, 1994

[51] Int. Cl.[6] ..... H01R 13/703

[52] U.S. Cl. ..... 439/188; 200/51.1; 439/944

[58] Field of Search ..... 439/188; 200/51.1; 29/874, 876

[56] References Cited

U.S. PATENT DOCUMENTS

| | | | |
|---|---|---|---|
| 3,627,929 | 12/1969 | Hermanus Petrus et al. | 439/188 |
| 3,873,785 | 3/1975 | Lieberman | 200/51.1 |
| 3,912,889 | 10/1975 | Bright | 200/51.1 |
| 4,628,159 | 12/1986 | Deitch et al. | 200/51.05 |
| 4,988,307 | 1/1991 | Muzslay | 439/188 |
| 5,030,122 | 7/1991 | Birch et al. | 439/188 |
| 5,076,797 | 12/1991 | Moulton | 439/188 |
| 5,145,391 | 9/1992 | Alwine | 439/188 |
| 5,174,775 | 12/1992 | Birch | 439/581 |
| 5,201,853 | 4/1993 | Alwine | 439/188 |
| 5,334,025 | 8/1994 | Fohl | 439/188 |

*Primary Examiner*—Neil Abrams

*Attorney, Agent, or Firm*—Freilich Hornbaker Rosen

[57] ABSTRACT

A connector system is provided wherein a first connector (12, FIG. 1) has outer and inner contacts (50, 52) that are normally "shorted" to one another until the first connector is mated to a second one (14), which facilitates the conversion of one or more coax regions of each connector for switching. A conductive switch element (60) can be mounted on the pin-shaped inner contact, the switch element including a sleeve (62) that tightly fits around the pin and also including a pair of switch arms (64, 66) extending rearwardly and radially outwardly from the front of the sleeve. A corresponding coax region of the second connector is devoid of outer and inner contacts, but instead includes an actuator (80) with an insulative tubular part (82) that is mounted in the second housing in place of an outer contact thereat.

11 Claims, 2 Drawing Sheets

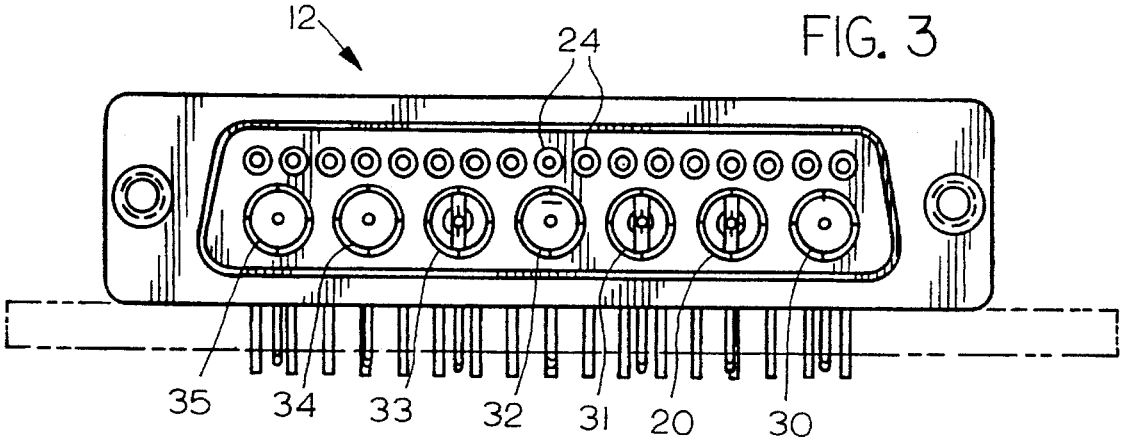
FIG. 3
FIG. 8
MATED
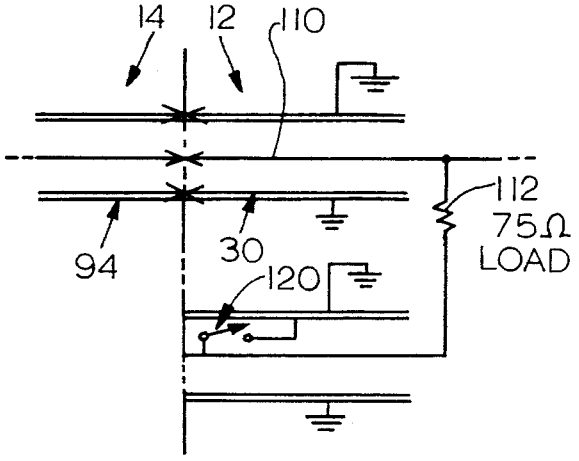
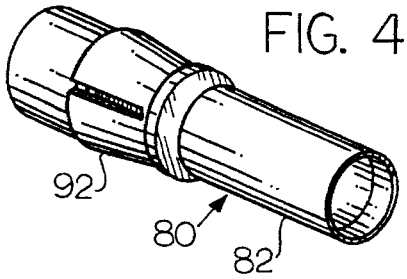
FIG. 4
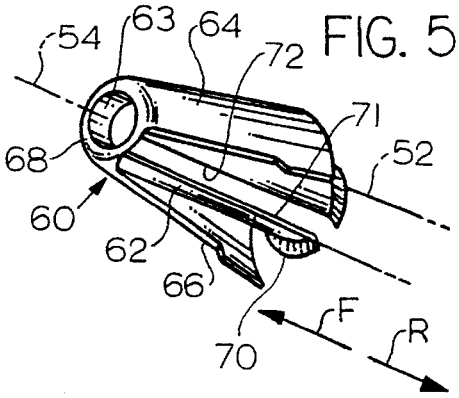
FIG. 5
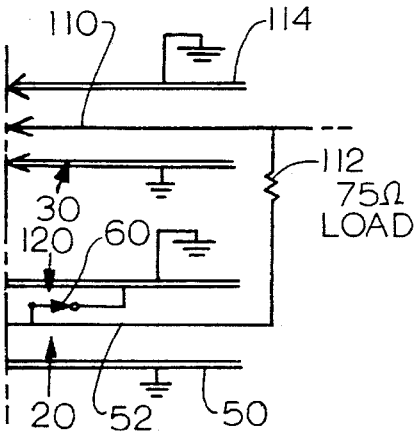
FIG. 7
UNMATED
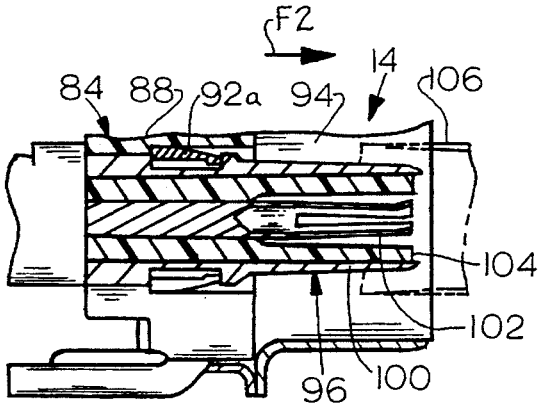
FIG. 6

SWITCHING CONNECTOR

BACKGROUND OF THE INVENTION

There are applications where it is desirable to connect or "short" a pair of contacts of a first connector when that first connector is not mated to a second one, but to disconnect the contacts when the connectors are mated. In low frequency applications, such a switching contact can be used to sense when the connectors are mated. In high frequency applications (usually above 1 MHz) such a switching contact can be used to connect a source of high frequency signals through a load such as a 75 ohm resistor, to ground, to dissipate power constantly generated by the source. For such high frequency applications, it is often desirable to provide a coaxial connector portion to minimize EMI (electromagnetic interference) and losses.

There have been several approaches to the construction of shorting contacts, including shorting contacts for coaxial connectors. However, prior suggestions have involved the construction of a special connector to provide a switch contact, or a conversion of an existing connector where the conversion is difficult to perform. If a selected coaxial contact region of an existing first connector could be readily converted to a switching contact, and a corresponding coaxial contact region of a mating second connector could be readily converted to serve as an actuator for the switching contact, then switching provisions could be readily constructed and/or provided in connectors with several coaxial contact regions.

SUMMARY OF THE INVENTION

In accordance with one embodiment of the present invention, a connector assembly is provided which facilitates the conversion of coax regions of connectors that have coaxial contacts, to provide a mate-sensing switch at one of such regions. A switch element is provided which includes a sleeve that can fit tightly about an inner contact which is in the form of a pin. The sleeve also has switch arms that extend rearwardly and radially outwardly. The switch element can be installed in the coax region of a first connector by merely pressing its sleeve onto the pin at that coax region. The switch element then serves as a switch that "shorts" or connects the pin and surrounding outer contact when the switch is closed.

The second connector has a corresponding coax region. An actuator is provided for mounting thereat that can deflect the switch arms to open the switch formed by the switch element. The second connector has a retention structure at each coax region to hold at least outer coaxial contacts. The actuator is mounted on a corresponding retention structure in place of an outer coaxial contact.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on the line 3—3 of FIG. 1.

FIG. 4 is an isometric view of the tubular part and the retention clip of the second connector of FIG. 1.

FIG. 5 is an isometric view of the switch element and pin inner contact of the first connector of FIG. 1.

FIG. 6 is a partial sectional view of the second connector of FIG. 1, taken at another coax region thereof.

FIG. 7 is a schematic diagram showing one connection arrangement for the first connector of FIG. 1, shown in the unmated configuration.

FIG. 8 is a view similar to that of FIG. 6, but showing a second connector and showing the connector assembly in the mated configuration.

DESCRIPTION OF THE PREFERRED EMBODIMENT

Figure 1:
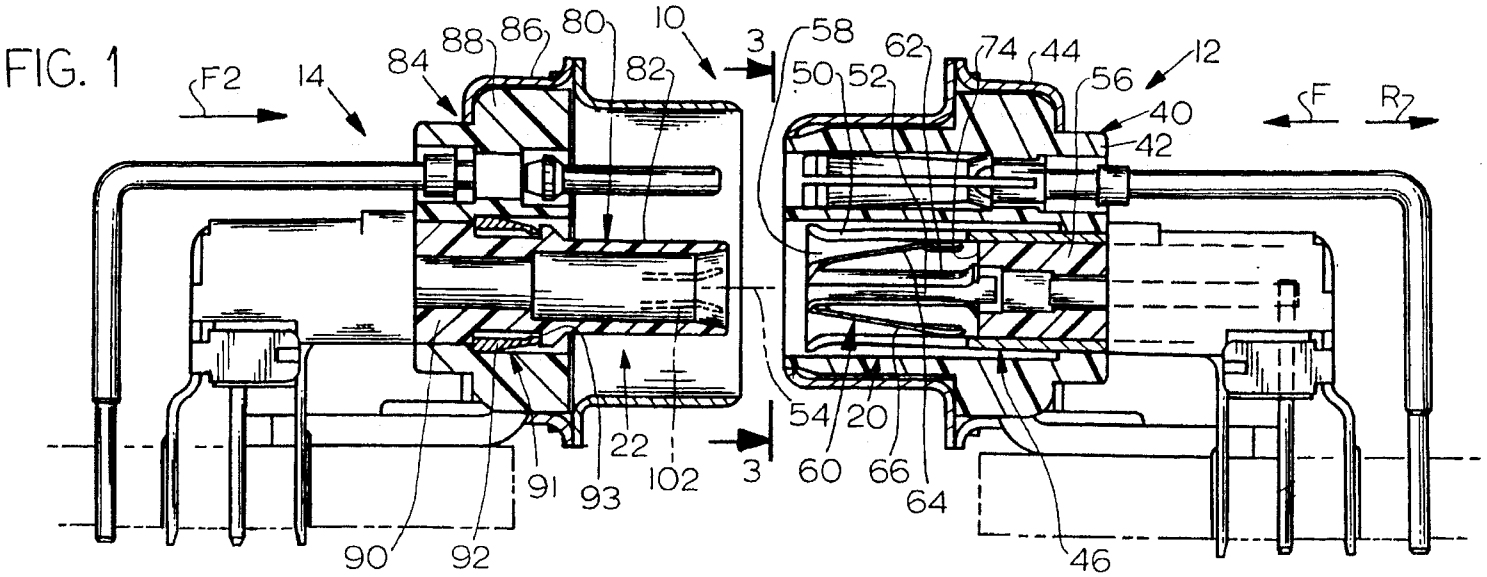
FIG. 1 is a sectional side view of a connector assembly constructed in accordance with the present invention, with the first and second connectors separated and in their unmated configurations.

FIG. I illustrates a connector assembly 10 which includes a receptacle or first connector 12 and a plug or second connector 14. The first and second connectors have corresponding first coax regions 20, 22 that can mate. As shown in FIG. 3, the first connector 12 has seventeen lower frequency contact regions 24 and has seven higher frequency coax regions 20, 30–35. This connector 12 is identical to a previous connector sold by the present assignee for at least about twenty-five years, except that there are modifications, or conversions, at three of the coax regions 20, 31, and 33 to convert them into mate-sensing switches. The second connector 14 is also similar to a connector long sold by the present assignee, but with three coax regions that have been converted to actuate switches at the three converted regions 20, 31, 33 of the first connector 12.

As shown in FIG. 1, the first connector 12 includes a housing 40 that includes an insulator 42 and a shell 44. A coaxial contact arrangement 46 is mounted in the first coaxial region 20 of the housing. The coaxial arrangement includes a conductive sleeve-like outer contact 50 and a conductive inner pin contact 52 lying along an axis 54 of the coax region. The arrangement also includes an insulative spacer 56 lying between rearward portions of the outer and inner contacts. Forward portions of the outer and inner contacts are provided with a space 58 between them, which is not occupied by the spacer 56.

Applicant converts the first coax region 20 to a mate-sensing switch, by the addition of a switch element 60. As shown in FIG. 5, the switch element 60 includes a sleeve 62 with an inner surface 63 that fits closely around the pin inner contact or pin 52. The sleeve has a length at least equal to its diameter or that of the pin, to lie stably on the pin. The switch element also includes at least one, and preferably two switch arms 64, 66 that extend rearwardly (along arrow R) and radially outwardly (with respect to axis 54) from the front end 68 of the sleeve, with a substantially 180° bend at the front of the cylinder. The sleeve has a rear end 70 that is outwardly flared and which forms a stop that limits the depth of rearward insertion of the switch element onto the pin 52. The switch element is formed of a piece of resilient sheet metal such as beryllium copper, with the sleeve 62 having largely axially-extending edges 71 forming a gap 72 therein. In its undeflected position (when not on the pin) the sleeve has a smaller inside diameter than that of the pin, so there is an interference fit with the pin. Accordingly, the sleeve 62 can be mounted on the pin by merely sliding it over the pin as shown, with the interference fit resulting in friction that keeps the switch element in place.

Referring again to FIG. 1, it can be seen that the sleeve 62 abuts a forward end 74 of the insulative spacer 56. Each of the nonconverted coax regions of the first connector are identical to the region 20, except that they do not have the switch element 60 installed thereon. Accordingly, conversion of a coax region of the first connector to a mate-sensing switch, is performed very easily and at low cost, by merely slipping the switch element over the pin contact or pin 52. The first coax region 20 can be changed back to its original unconverted configuration, by merely pulling off the switch element 60.

Figure 2:
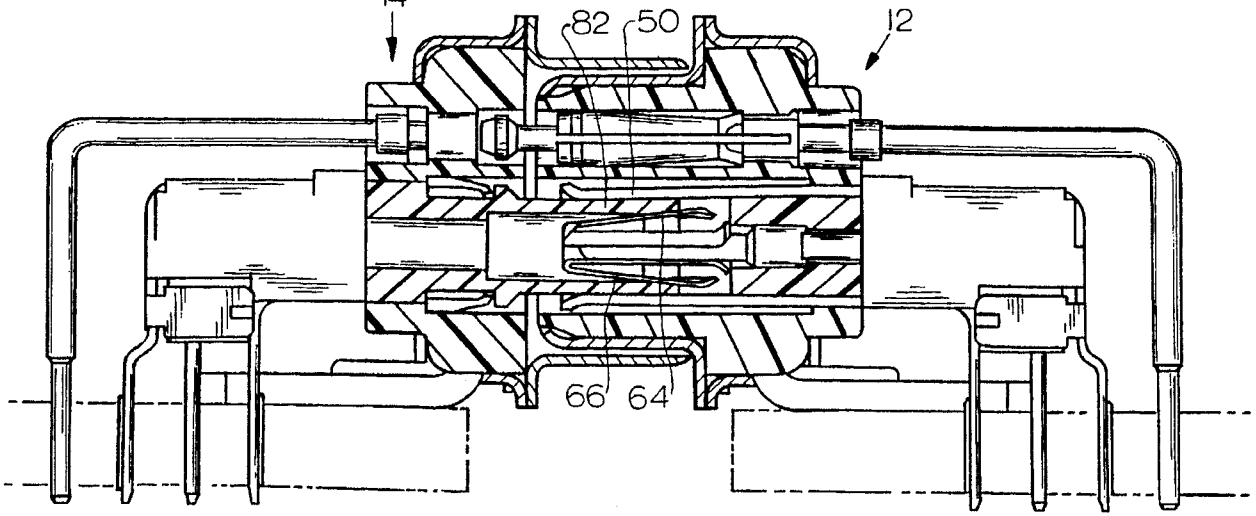
FIG. 2 is a view similar to that of FIG. 1, but with the connectors mated.

The second connector 14 includes an actuator 80 which comprises an insulative tubular part 82 that is constructed to fit in the space 58 of the first coax region of the first connector to deflect the switch arms 64, 66. FIG. 2 shows the connectors 12, 14 in their fully mated positions, and with the insulative tubular part 82 of the actuator having deflected the switch arms 64, 66, so they are out of engagement with the outer contact 50 of the first connector.

As shown in FIG. 1, the second connector 14 includes a housing 84 which comprises a conductive shell 86 and an insulator 88. The actuator has a rear portion 90 which is retained in the insulator 88 of the housing by a retention structure 91 that includes a clip retainer 92 and a housing groove 93. The outer surface of the rear portion 90 of the actuator is substantially identical to the outer surface of a contact assembly that would otherwise fit in the coaxial region 22 of the second connector. As shown in FIG. 6, each of the unconverted coax regions of the second connector which are utilized, such as region 94, includes a coax contact assembly 96 which is designed to mate with one of the unconverted coax contact arrangements (46 in FIG. 1) of the first connector. The contact arrangement 96 includes an outer coax contact device 100, an inner coax contact device 102, and an insulative spacer 104 between the contact devices. The outside of the outer coaxial contact device 100 is substantially identical to the outside of the rear portion of the actuator (80 in FIG. 1), and is designed to be held in place by a substantially identical retention structure that includes clip retainer 92*a*.

The second coax region 22 of the second connector shown in FIG. 1, can be easily converted to hold the actuator 80, by installing the actuator 80 in place of the coaxial contact arrangement 96 of FIG. 6. It is noted that the coaxial contact arrangement 96 of the unconverted coax region of FIG. 6 can be removed by inserting a tool indicated at 106 to contract the clip retainer 92*a* and enable the contact assembly 96 to be pulled in a forward direction F2 out of the second connector. If the second connector has a contact arrangement 96 where it is desired to install an actuator, this can be easily accomplished. However, the connector manufacturer can merely originally install the actuator instead of the contact arrangement 96.

FIG. 7 shows converted and unconverted coax regions 20, 30 of the first connector, whose inner contacts 52, 110 are connected through a 75 ohm resistive load 112. Outer contacts 50, 114 of the two regions 20, 30 are grounded, or at least connected to each other to always be at the same potential with respect to ground. When the first connector 12 is not mated to the second one, a switch 120 formed by the switch element 60 and the inner and outer conductors, is closed. Then, the center coaxial conductor 110 at the unconverted coax region 30 is connected through the load 112 to ground. FIG. 8 shows the connectors 12, 14 mated, at which time the center conductor 110 of the region 30 must not be connected through the load 112 to ground. At that time, the switch 120 is open so no current flows through the load 112.

Thus, the invention provides a connector assembly having first and second mateable connectors that may be similar or identical (in housing) to popular prior art connectors, a switch element that can be easily mounted at a first coax region of the first connector, and an actuator that can be easily mounted at a second coax region of the second connector. The switch element can be merely installed on a pin inner contact to convert it to a switch. The actuator can be installed by substituting it for a contact assembly thereat, using the same retention structure. The ability to use a well known and reliable prior art connector and to readily convert it to provide a mate-sensing switch, enables the provision of a connector assembly that is well known in the trade as being reliable, that is of low cost, and that can be converted at low cost.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector assembly that includes first and second connectors each having a coax region that is mateable with a coax region of the other connector, wherein said first connector has a first housing with an open front end at a first of said coax regions, has electrically conductive coaxial outer and inner contacts mounted at said first coax region with front contact ends at said open front end, and has at least one deflectable conductor that is connected to a first of said coaxial contacts and which is biased to engage the other of said coaxial contacts but which is deflectable out of engagement with said other of said coaxial contacts, and said second connector has a second housing and has an actuator with an insulative tubular part that is mounted in said second housing and that is constructed to fit between said coaxial contacts and deflect said at least one deflectable conductor out of engagement with said other of said coaxial contacts when said connectors are mated, characterized by:

said coaxial inner contact is in the form of a pin, and including an electrically conductive switch element which includes a sleeve that fits around said pin and that also includes at least one switch arm that extends rearwardly and radially outwardly from said sleeve and that has a rear portion biased radially outwardly to engage said outer coaxial contact, said switch arm forming said deflectable conductor.

2. The connector assembly described in claim 1 wherein:

said sleeve of said switch element has an inner sleeve surface and is spring biased to urge its inner sleeve surface to a smaller diameter than a corresponding portion of said pin to frictionally engage said pin, with said inner surface having an axial length at least equal to its inside diameter, to thereby stabilize its orientation on said pin.

3. The connector assembly described in claim 1 wherein:

said first and second connectors each has a nonconverted coax region, with said nonconverted coax region of said first connector having coaxial outer and inner contacts and being substantially identical to said first coax region except that said nonconverted coax region of said first connector is devoid of a switch element;

said nonconverted coax region of said second connector is substantially identical to a second coax region thereof, but said second connector includes outer and inner contact devices at said nonconverted coax region thereof which are mateable to the coaxial outer and inner contacts of said nonconverted coax region of said first connector, with said outer contact device having a rear portion, and said housing of said second connector has a retention structure at said nonconverted region thereof which holds said rear portion of said outer contact device;

said housing of said second connector has a retention structure at said second coax region thereof which is substantially identical to said retention structure at said first nonconverted coax region thereof, and said actuator has a rear portion with an outer surface of substantially the same shape as that of said rear portion of said outer contact device.

4. The connector assembly described in claim 1 wherein:

said switch element comprises a piece of sheet metal with a first portion rolled into a cylinder of smaller undeflected inside diameter than said pin and having forward and rearward ends, to form said sleeve, and with a pair of portions of said piece of sheet metal extending from the forward end of said cylinder and being bent by almost 180° to extend largely rearwardly and form said at least one switch arm.

5. A connector assembly that includes first and second mateable connectors with respective first and second housings that each have respective first and second coax regions, wherein at a nonconverted one of said first coax regions and at a converted one of said first coax regions said first connector has a pin inner contact and a coaxial outer contact and forms an annular space between them that is open at the front of the connector, and at each of said second coax regions of said second housing said second connector has substantially identical retention structures, and at a nonconverted one of said second coax regions said second connector has a socket inner contact device that is mateable to said pin inner contact and has an outer contact device that is mateable to said coaxial outer contact and that is held to one of said retention structures, comprising;

a switch element mounted on said pin inner contact at said converted first coax region of said first housing, said switch element having at least one arm that extends rearwardly and radially outwardly and against said outer coaxial contact;

an actuator mounted to said retention structure at a converted one of said second coax region of said second housing, said actuator including an insulative tubular part that is receivable in said annular space of said converted first coax region to deflect said arm away from said outer contact.

6. The connector assembly described in claim 5 wherein:

said switch element includes a sleeve that is closely received about said pin inner contact and said at least one arm extends from a front end of said sleeve.

7. A coaxial connector comprising:

a housing;

a coaxial contact arrangement that includes outer and inner contacts that are coaxial with an axis and that are mounted in said housing and that have forward portions with an annular space between them;

an electrically conductive switch element having a first portion mounted on said inner contact and having a plurality of arms extending from said first portion and against said outer contact, said arms being deflectable away from said outer contact;

said first portion of said switch element comprising an axially elongated sleeve of a length at least as great as the width of said sleeve, and that lies closely around said inner contact.

8. The connector described in claim 7 wherein:

said switch element comprises a piece of sheet metal with said first portion rolled into the shape of said sleeve, with spaced largely axially-extending sleeve edges, and with said sleeve having an undeflected inside diameter that is less than the outside diameter of said inner contact.

9. A switch element that can be mounted on a coaxial pin inner contact to short it to a coaxial outer contact, comprising:

a piece of sheet metal forming a sleeve portion extending along an axis that extends in forward and rearward direction, said sleeve portion having largely axially extending edges to enable expansion of the sleeve portion and mount it on the pin inner contact, and said piece of sheet metal forming a plurality of rearwardly and radially outwardly extending arms for engaging said outer contact.

10. A method for constructing a connector assembly that includes first and second mateable connectors with respective first and second housings that each have respective first and second coax regions, where at each of said first coax regions of said first housing said first connector has a pin inner contact and a coaxial outer contact and forms an annular space between them that is open at a front end of the first connector, and at each of said second coax regions said second housing has a retention structure which can receive and retain a device to enter said annular space between said contacts, and wherein at a nonconverted one of said second coax regions said second connector has a socket inner contact device that is mateable to said pin inner contact and has an outer contact device that is mateable to said outer contact, comprising;

attaching a switch element to one of said pin inner contacts at one of said first coax region of said first housing, wherein said switch element has at least one arm that extends rearwardly and radially outwardly and against said outer contact;

attaching an actuator to one of said retention structures at one of said second coax region of said second housing, wherein said actuator includes an insulative tubular part that can fit in said annular space to deflect said arm away from said outer contact.

11. The method described in claim 10 wherein:

said step of attaching a switch element includes forming a piece of sheet metal with a plurality of arms forming said at least one arm and with a sleeve portion that has spaced largely axially-extending edges, with said sleeve portion having an undeflected inside diameter smaller than said pin contact, and inserting said sleeve portion around said pin contact and holding said sleeve in place with friction caused by the tendency of said sleeve portion to return to it undeflected inside diameter.

* * * * *